US005165134A

United States Patent [19]

Moore

[11] Patent Number: 5,165,134

[45] Date of Patent: * Nov. 24, 1992

[54] SWEEPING AND DUSTING APPARATUS

[76] Inventor: Terry D. Moore, 2415 Hinton Rd., Dacula, Ga. 30211

[ * ] Notice: The portion of the term of this patent subsequent to Feb. 5, 2008 has been disclaimed.

[21] Appl. No.: 613,292

[22] Filed: Nov. 15, 1990

Related U.S. Application Data

[63] Continuation-in-part of Ser. No. 473,348, Feb. 1, 1990, Pat. No. 4,989,288, which is a continuation-in-part of Ser. No. 381,014, Jul. 17, 1989.

[51] Int. Cl.[5] ..... A47L 1/02

[52] U.S. Cl. ..... 15/98; 15/49.1; 15/78; 15/229.3

[58] Field of Search ..... 15/229.3, 229.4, 246, 15/49.1, 50.1, 83, 78, 98

[56] References Cited

U.S. PATENT DOCUMENTS

| | | | |
|---|---|---|---|
| 1,349,680 | 8/1920 | Link | 15/229.3 |
| 2,268,519 | 12/1941 | Teager | 15/78 |
| 2,890,470 | 6/1959 | Shaefer | 15/229.4 X |
| 3,134,129 | 5/1964 | Allen | 15/159 R |
| 4,989,288 | 2/1991 | Moore | 15/78 X |

*Primary Examiner*—Paul T. Sewell
*Assistant Examiner*—BethAnne Cicconi
*Attorney, Agent, or Firm*—James B. Middleton

[57] ABSTRACT

At least one dust mop is fixed to a carrier, the carrier being receivable on the forks of a fork lift. The forks can be used to position the mop with respect to the floor, and the mop is carried on a pivoted arm so the mop floats for proper pressure even with some variation in height of the carrier. The mop defines an angle for collecting and retaining dirt, and the mop is resiliently allowed to pivot when the mop engages an obstruction. One mop bent at an angle may be used, or two mops angularly disposed with respect to each other may be used.

8 Claims, 2 Drawing Sheets

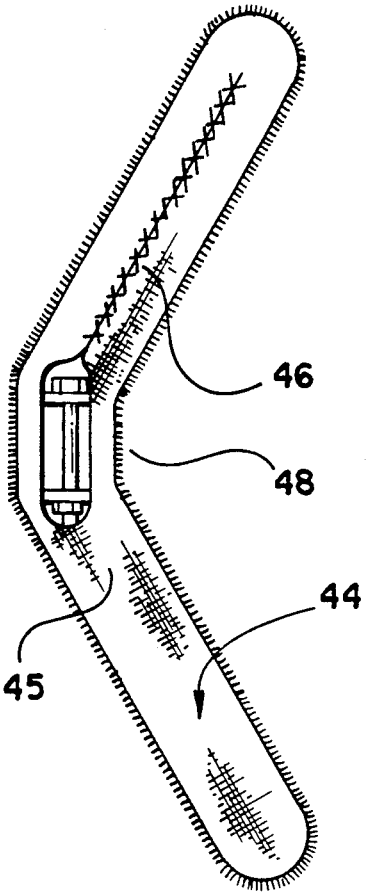
Fig_5
Fig_6
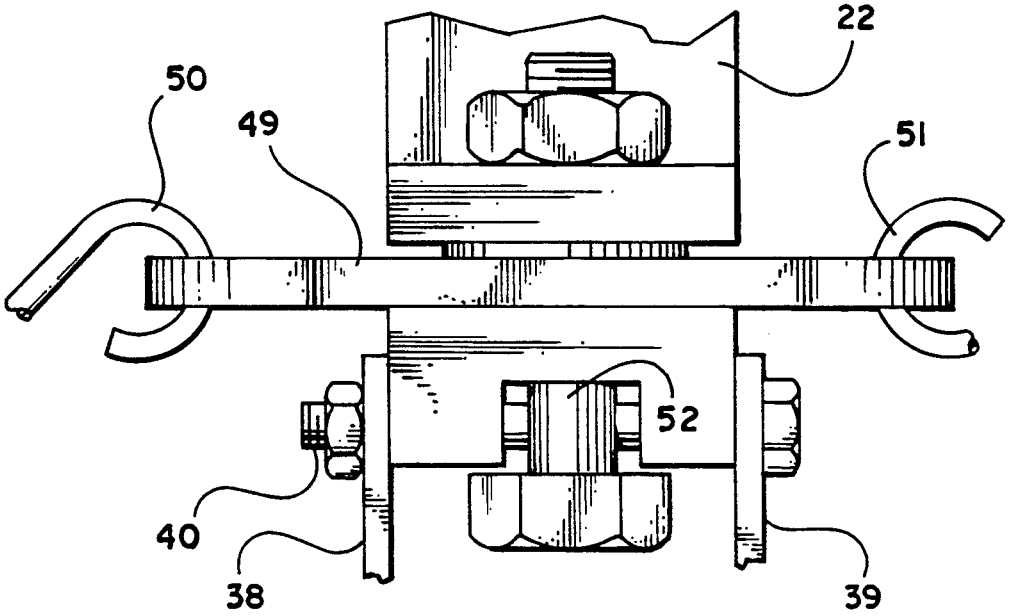

SWEEPING AND DUSTING APPARATUS

CROSS-REFERENCE TO RELATED APPLICATION

This application is a continuation-in-part of the copending application of the same inventor filed Feb. 1, 1990, under Ser. No. 473,348 titled "Sweeping and Dusting Apparatus" now U.S. Pat. No. 4,989,288 on Feb. 5, 1991, which is in turn a continuation-in-part of the copending application filed Jul. 17, 1989, under Ser. No. 381,014, titled "Carrier for Dust Mops".

INFORMATION DISCLOSURE STATEMENT

In warehouses and the like, dust and dirt are common problems that are normally dealt with by sweeping the floor. It will be understood, however, that the floor space to be swept tends to be rather extensive so that sweeping by hand is economically unfeasible except for extremely small warehouses. To solve the problem in large warehouses, the prior art has provided a self powered sweeper that typically utilizes rotating brushes to move dirt inwardly, towards the sweeper, and frequently utilizes vacuum means to assist in lifting the dirt and debris from the floor. While these self powered sweepers are capable of removing a good bit of dirt and debris from the floor, it will be understood by those skilled in the art that a considerable amount of dust is stirred up and placed into the air because of the agitation by the brushes. Having dust in the air is undesirable from the standpoint of the workers in the warehouse, and it is further undesirable in that the dust will settle on the merchandise in the warehouse. The usual alternative is a manually pushed dust mop, which is not practical for a warehouse of any considerable size.

One prior art effort at solving the above mentioned problems comprised the mounting of a plurality of dust mops on a frame to be carried by a fork lift. While this constituted an improvement over the prior arrangements, the mounting of the dust mops was insecure so that the mops were likely to become separated from the carrier. Also, the dust mops were positioned parallel to one another and laterally of the fork lift, which is not effective in sweeping a floor.

SUMMARY OF THE INVENTION

This invention relates generally to cleaning apparatus, and is more particularly concerned with a sweeping and dusting means to be carried by a fork lift or the like.

The present invention provides a carrier selectively receivable on the forks of a conventional fork lift or otherwise mounted on an industrial truck. The carrier mounts at least one dust mop. The dust mop provides an angular sweeping means oriented for receiving and trapping dirt and debris as the dust mop moves across the floor. The angular orientation of the dust mop is held resiliently to allow deviation in the event a mop strikes an obstruction.

In the preferred embodiment of the present invention, the dust mop floats with respect to the carrier to allow substantially uniform pressure of the dust mop against the floor without critical height adjustment of the forks of the fork lift.

BRIEF DESCRIPTION OF THE DRAWINGS

These and other features and advantages of the present invention will become apparent from consideration of the following specification when taken in conjunction with the accompanying drawings in which:

FIG. 5 is a view similar to FIG. 4, but having a mop installed on the frame; and, FIG. 6 is an enlarged fragmentary view showing the means for mounting a mop frame of FIG. 4 to the carrier arm.

DETAILED DESCRIPTION OF THE EMBODIMENT

Figure 1:
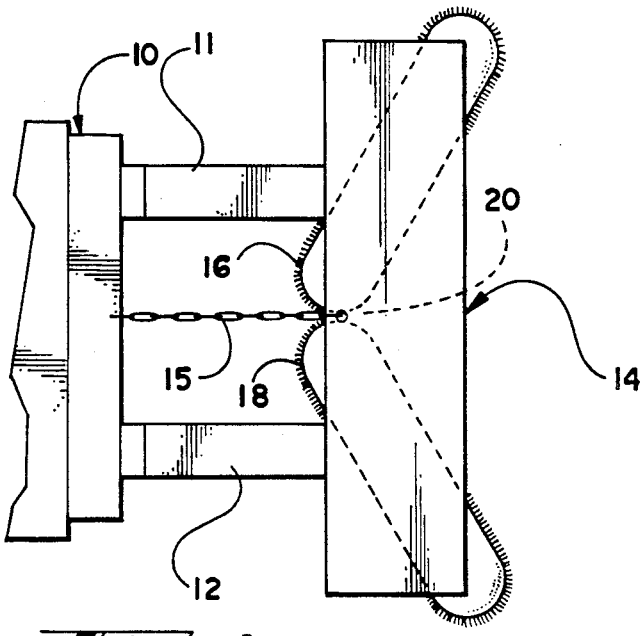
FIG. 1 is a top plan view showing a cleaning apparatus made in accordance with the present invention, the apparatus being carried on the forks of a conventional fork lift.

Referring now more particularly to the drawings, and to those embodiments of the invention here chosen by way of illustration, FIG. 1 illustrates a conventional industrial truck designated at 10 having forks 11 and 12 extending forwardly therefrom. The carrier of the present invention, designated generally at 14, is received on the ends of the forks 11 and 12, and there is a chain 15 fixed to the carrier 14 and to the industrial truck 10. While the chain 15 may not be required, it does provide some safety to prevent the carrier 14 from being inadvertently removed from the forks 11 and 12.

The carrier 14 mounts a plurality of dust mops indicated at 16, and 18. It will be seen that the mops 16 and 18 are arranged with the mops 16 and 18 extending angularly outwardly to form a V shape. This arrangement is shown somewhat in the broken line representation in FIG. 1, but is illustrated more clearly in FIG. 2. Because of the angular arrangement shown, it will be understood that the dust mops 16 and 18 will sweep a wide swath, and the angular arrangement will cause dirt and debris to move inwardly and be retained in the area designated at 20 between the dust mops 16 and 18.

The later filed copending application identified above discloses an arrangement very similar to that shown in FIGS. 1 and 2 of the drawings, and that disclosure is incorporated herein by reference. The copending application discloses an arrangement that is workable, but three individual dust mops are required to form the V shape. In the present invention, only two mops are shown, and substantially the same result is achieved.

Figure 2:
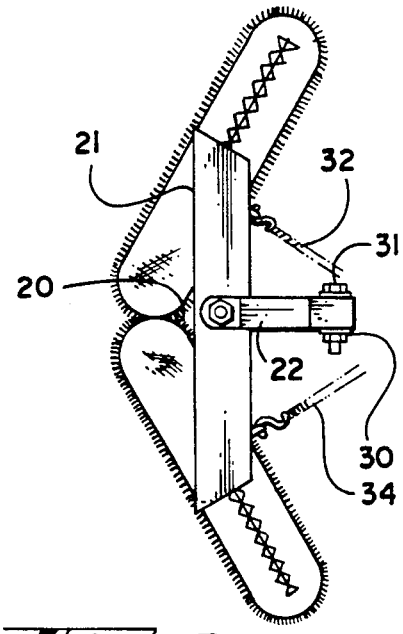
FIG. 2 is a view similar to FIG. 1 with the carrier removed and showing the mounting of the dust mops.

In FIG. 2 of the drawings, it will be noticed that each of the mops 16 and 18 is shown as carried by a connecting arm 21, the connecting arm 21 being carried by an arm 22 like the arms in the copending application. Thus, the mops 16 and 18 are angularly fixed with respect to the connecting arm 21, and the connecting arm 21 floats vertically on the arm 22.

Figure 3:
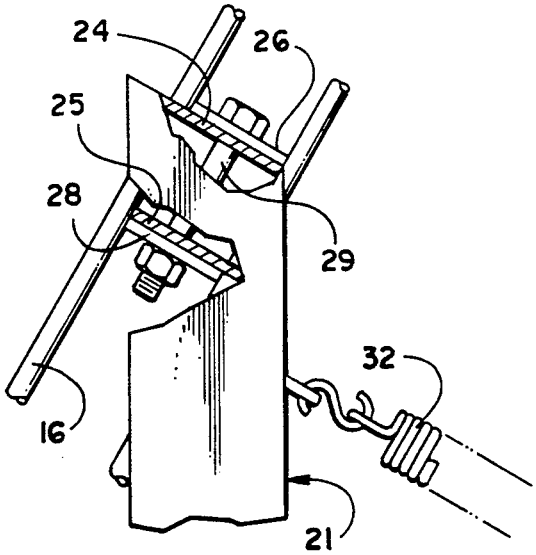
FIG. 3 is a fragmentary view showing the attachment of a mop to a connecting arm of the carrier illustrated in FIG. 1.

FIG. 3 of the drawings shows the connection of the mop 16 to the connecting arm 21. The connecting arm has an angled end, and there are depending flanges 24 and 25. The flanges 24 and 25 are parallel to each other, and are set at an angle as desired for the angle of the mop 16. The frame of the mop 16 is illustrated in FIG. 3, and it will be noticed that the mop frame includes a pair of upstanding flanges 26 and 28. The mop flanges 26 and 28 are spaced to lie just outside the flanges 24 and 25; and, all four of these flanges define openings therethrough to receive a screw 29. The mop head is pivotal to some extent about the screw 29, but the mop 16 is otherwise fixed with respect to the connecting arm 21.

The mop 18 is fixed to the connecting arm 21 in the same manner as the mop 16, so the description will not be repeated. The mop 18 is angled oppositely to the mop 16, and the mops 16 and 18 virtually touch in the middle, adjacent to the area 20. It will be understood by those skilled in the art that the mop frames will be slightly spaced from each other; however, when the mops are placed on the frames, the bulk of the two mops 16 and 18 is sufficient to prevent dust and dirt from passing between the mops.

In the device disclosed in the co-pending application, the individual mops are individually pivoted. In the present case, however, if one mop is pivoted, collected dirt will quickly be lost. Thus, the present device has the two mops 16 and 18 fixed to the connecting arm 21, and the connecting arm 21 is pivotal on the arm 22. With this arrangement, the two mops 16 and 18 will pivot together, maintaining the V-shaped means for retaining the collected dirt.

As in the previous application, the arm 22 is pivotally attached to the carrier 14. A depending bracket 30 receives a screw 31 that passes through the arm 22. Since the connecting arm 21 is the pivoting structure, the spring means is arranged to hold the arm 21 resiliently in place. There is a pair of springs 32 and 34 hooked between the connecting arm 21 and the carrier 14. The springs 32 and 34 exert equal forces, so the mops 16 and 18 are normally held in the position shown in the drawings. If a mop engages an obstruction, the connecting arm 21 will rotate to allow the mop to pass the obstruction, and the assembly will return to the normal position under the influence of the springs 32 and 34.

It will therefore be understood that the device illustrated in FIGS. 1-3 of the drawings provides a simple and effective sweeping and dusting apparatus. The device utilizes two mops to yield an angular sweeping means that will gather and retain dust and dirt.

Figure 4:
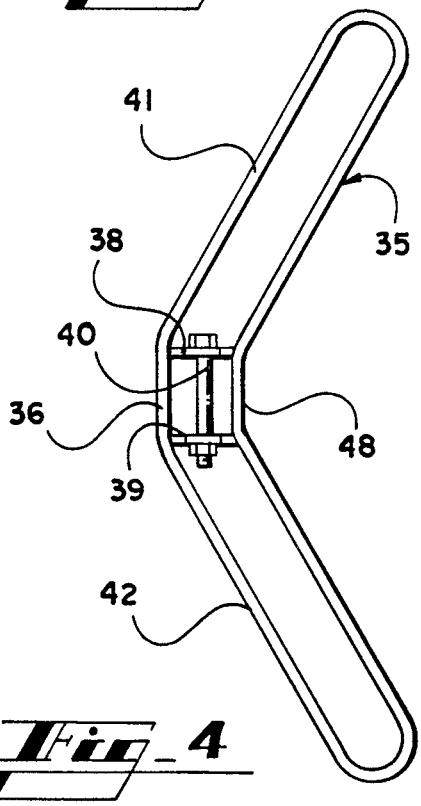
FIG. 4 is a top plan view of a modified form of mop frame for use in an embodiment of the present invention.

Another embodiment of the present invention is shown in FIGS. 4 and 5 of the drawings. Remembering the above described arrangement, the object is to provide the angular sweeping means to gather and retain dirt. The device shown in FIGS. 4 and 5 achieves this end using only one mop.

FIG. 4 is a top plan view showing a mop frame generally designated at 35. The frame 35 includes a center portion 36 that is generally conventional, except that upstanding flanges 38 and 39 replace the usual wires. A machine screw 40 is passed through the two flanges 38 and 39 to act as the mounting pintle for the mop.

The frame 35 has two wing portions 41 and 42 as is conventional for a mop frame; but, the wings 41 and 42 are angled forwardly. The particular angle is not critical, but an angle in the vicinity of 30° from the longitudinal centerline of the screw 40 has been found to be quite satisfactory.

FIG. 5 of the drawings shows a cover for the frame 35, the cover 44 being shaped the same as the frame 35. Those skilled in the art will realize that mop covers, or mop heads, of the type here illustrated are formed of fabric and string, and are quite flexible. Further, one of the wing portions of the mop 44 defines a closed pocket 45, while the opposite one of the wing portions defines an openable pocket 46 having laces or other closure means. Because of this construction, the conventional mop head 44 can be used on the frame 35. The wing portion 42 can be inserted into the pocket 45; then, the pocket 46 can be opened and wrapped around the wing portion 41. The pocket 46 can be laced-up or otherwise closed and the mop is installed. The mop then defines the collecting area 48.

In using the device shown in FIGS. 4 and 5, an attachment means similar to that shown in the prior application will be used. The device is shown in FIG. 6 of the drawings. The device will be carried by an arm 22 like that shown in FIG. 2 of the drawings, so the arm in FIG. 6 is also designated at 22.

The attachment means is described in detail in the earlier, co-pending application, and that description will not be repeated in full. The elongate member 49 receives hooks 50 and 51 to connect springs such as the springs 32 and 34. Flanges 38 and 39 receive the screw 40 therethrough, the screw 40 also passing through an appropriate hole through the pivot bolt 52. The pivot bolt 52 pivotally secures the attachment means to the arm 22.

The present invention therefore provides a sweeping apparatus that may use either one or two dust mops, yet achieve substantially the same results as the prior co-pending application. The mops are vertically floatable to allow the carrier 14 to be approximately placed with respect to the floor to be swept, and the mops will engage the floor in accordance with the weight of the mop assembly. Two mops may be held with respect to each other to provide the angular sweeping means that will collect and hold dirt. The two mops will move in unison in the event one mop strikes an obstruction. One mop may itself be angled to provide the angular sweeping means, the mop being resiliently held in position to allow pivoting in the event one end of the mop engages an obstruction.

Utilizing the apparatus of the present invention, the floor will be adequately swept and dusted, but there is no agitation sufficient to raise a cloud of dust and cause dirt and dust to be airborne.

Since virtually every warehouse has at least one fork lift or similar industrial truck, it will be understood that the apparatus of the present invention can be readily adapted for use without investment in additional expensive equipment. The dust mops 16, 18 and 44 are completely conventional so that, as the mops themselves wear out, replacement mops can be obtained and placed on the existing mop frames such as the mop frame 35.

It will therefore be understood by those skilled in the art that the particular embodiments of the invention here presented are by way of illustration only, and are meant to be in no way restrictive; therefore, numerous changes and modifications may be made, and full use of equivalents resorted to, without departing from the spirit or scope of the invention as outlined in the appended claims.

I claim:

1. Sweeping apparatus, for use with an industrial truck, said sweeping apparatus including a carrier selectively carried by the industrial truck for movement over a floor in a given direction, at least one dust mop mounted on said carrier for movement with said carrier, said at least one dust mop defining an angular sweeping means including a first portion angularly disposed with respect to said given direction and a second portion angularly disposed with respect to said given direction, said first portion and said second portion being angled oppositely to each other and defining a collecting area, said collecting area being between said first portion and said second portion, said first portion including a first end disposed forwardly of said collecting area, said second portion including a first end disposed forwardly of said collecting area, and spring means for resiliently maintaining the angular disposition of said at least one dust mop with respect to said carrier.

2. Sweeping apparatus as claimed in claim 1, and further including an arm fixed to said carrier, said at least one mop being carried by said arm and pivotally mounted with respect to said arm.

3. Sweeping apparatus as claimed in claim 2, and further including a connecting arm disposed transversely to said direction of movement, said connecting arm being pivotally fixed to said arm, said at least one mop being fixed to said connecting arm for movement therewith.

4. Sweeping means as claimed in claim 3, said spring means being fixed to said connecting arm for resiliently maintaining the transverse disposition of said connecting arm.

5. Sweeping means as claimed in claim 4, said at least one mop comprising two mops, a first mop of said two mops being fixed to one end of said connecting arm and having a first end adjacent to said collecting area and a second end forward of said collecting area, a second mop of said two mops being fixed to the opposite end of said connecting arm and having a first end adjacent to said collecting area and a second end forward of said collecting area, said first end of said first mop and said first end of said second mop substantially touching and forming said collecting area.

6. Sweeping apparatus as claimed in claim 2, said mop further including a center portion between said first portion and said second portion, said center portion being substantially at said collecting area.

7. Sweeping apparatus as claimed in claim 6, and further including attachment means for fixing said center portion of said mop to said arm, said attachment means including a pivot bolt for allowing pivotal motion of said attachment means with respect to said arm.

8. Sweeping apparatus as claimed in claim 7, said attachment means further including an elongate member disposed transversely to said given direction, said spring means being connected between said elongate member and said carrier.

* * * * *